US008634741B2

(12) United States Patent
Ottaviani

(10) Patent No.: US 8,634,741 B2
(45) Date of Patent: Jan. 21, 2014

(54) LASER PRINTER CLEANING CARTRIDGE DEVICE AND METHOD

(76) Inventor: Paul Ottaviani, Las Vegas, NV (US)

( * ) Notice: Subject to any disclaimer, the term of this patent is extended or adjusted under 35 U.S.C. 154(b) by 276 days.

(21) Appl. No.: 13/225,705

(22) Filed: Sep. 6, 2011

(65) Prior Publication Data

US 2012/0057895 A1 Mar. 8, 2012

Related U.S. Application Data

(60) Provisional application No. 61/380,865, filed on Sep. 8, 2010.

(51) Int. Cl.
*G03G 21/20* (2006.01)
*G03G 15/16* (2006.01)
*G03G 15/20* (2006.01)

(52) U.S. Cl.
USPC ..... 399/92; 399/101; 399/123

(58) Field of Classification Search
USPC ..... 399/98, 99, 101, 91, 92, 93, 123, 355, 399/357, 358, 359, 360
See application file for complete search history.

(56) References Cited

U.S. PATENT DOCUMENTS 3,969,785 A 7/1976 Ogawa
4,412,736 A 11/1983 Sakamoto
5,028,959 A 7/1991 Gooray
5,594,532 A 1/1997 Tuvesson
5,754,197 A 5/1998 Shibata
2006/0213025 A1* 9/2006 Sawalski ..... 15/344
2010/0247114 A1* 9/2010 Cornell et al. ..... 399/12

FOREIGN PATENT DOCUMENTS

JP 2008055677 A * 3/2008

OTHER PUBLICATIONS

Machine translation of Shimizu, JP 2008-055677.*

* cited by examiner

*Primary Examiner* — David Gray
*Assistant Examiner* — Sevan A Aydin
(74) *Attorney, Agent, or Firm* — Daniel Boudwin; Global Intellectual Property Agency LLC

(57) ABSTRACT

A cleaning cartridge insert is provided for removing residual paper debris and toner from a laser printer in between printer cartridge removal and replacement. The cartridge comprises a modified laser printer cartridge with an internal cavity lined with an adhesive foam tape, a plurality of air inlet tubes and a drive roller having an adhesive outer surface. With the lid of the printer cartridge loading cavity is in an open state, the cartridge is placed therein into a working position, as would a replacement cartridge. Compressed air is then forced into the nozzles of the air inlet tubes, stirring paper dust, residual toner and debris from the interior of the printer and onto the foam tape adhesive within the cavity of the cartridge device. The lid is then closed, which initiates the drive roller for cleaning debris from the bias transfer roller via rotation during the machine initializing stage. The present invention is intended as a preventative maintenance device for laser printers, prolonging their useful life and the increasing service intervals wherein a specialist is required for maintenance and cleaning.

9 Claims, 2 Drawing Sheets

LASER PRINTER CLEANING CARTRIDGE DEVICE AND METHOD

CROSS REFERENCE TO RELATED APPLICATION

This application claims the benefit of U.S. Provisional Application No. 61/380,865 filed on Sep. 8, 2010, entitled "Enhancement Cartridge."

BACKGROUND OF THE INVENTION

1. Field of the Invention

The present invention relates to laser printers. More specifically, the present invention pertains to a modified laser printer cartridge device that is inserted into a laser printer for cleaning loose debris and residual toner from a paper transport platform and bias transfer roller.

2. Description of the Prior Art

Laser printing is a type of computer printer that is utilized throughout business and industry for producing high quality printed material in a rapid manner. These devices utilize a laser beam that projects images or text onto a rotating bias transfer roller, which is electrically charged with negative ions to form a pattern. The laser beam neutralizes areas of the roller that will have toner transferred thereto to form a shape, image or text. The toner is then transferred onto a sheet of paper as the roller is pressed against the paper surface. This type of printing utilizes a xerographic printing process, which has been refined to produce printing machines that can produce a high volume of printed output in a rapid manner, far superior to the capability of inkjet printers. The amount of toner consumed is also reduced when compared to comparable inkjet printers, which reduces replacement costs for the owner.

Over the course of printing volumes of pages, residual toner, paper dust and other particles are commonly left behind, which can create a foreign object debris sources that could affect the operation of the printing device if not properly cleaned and maintained. Residual toner is often found on the bias transfer roller, which paper dust and other debris settle onto the paper transport platform and on other interior areas of the printer. Common tools to clean this residue includes manually cleaning and wiping components of the printer during defined maintenance intervals, providing an imbedded brush or cleaning device that physically removes toner or particles from the roller assembly, or replacing parts altogether with new, clean parts after a specific period.

Maintenance is usually carried out by technicians who are trained on the specific device and who are knowledgeable of its design and components. Regular service intervals ensure the printer will continue functioning as designed over a given time period. These maintenance procedures, however, are costly for the owner of the printer, and increase downtime of the device wherein no printing may occur. The present invention therefore is provided to provide a user with the ability to clean a laser printer when replacing an empty printer toner cartridge. The present invention is a device that can be installed in place of the existing cartridge, and provides a means to inject compressed air into the device for collection of loose debris and paper dust, which is secured to the interior of the device prior to its removal. A drive gear with adhesive cleans the bias transform roller of residual toner, which can cause clarity and imperfections in printed material if not removed. The goal is to prolong the life of the particular printer, and to reduce the number of service calls for maintenance and cleaning of the printer.

Devices have been developed in the prior art that pertain to cleaning printers. These include cartridge cleaning devices for inkjet printers and imbedded cleaning devices within laser printers. These devices lack the elements of the present invention, which is easily installed, provides a means to clean a laser printer device and can be discarded or cleaned for future use.

U.S. Pat. No. 5,754,197 to Shibata describes a cleaning cartridge for an inkjet printer, comprising a housing similar to a standard inkjet printer cartridge that has imbedded mechanisms for cleaning the printer printhead and removing debris therefrom. It includes imbedded battery power, and may dispense ink solvent, lubricant or staticide to various printer components. The Shibata device is a novel means for removing residual toner and debris from an inkjet printer; however it is not designed for use with a laser printer, wherein a bias transfer roller is utilized to transfer toner to a sheet of paper. The present invention provides a cartridge housing having compressed air inlet means and a bias transfer roller cleaner, specifically intended for laser printers.

U.S. Pat. No. 5,028,959 to Gooray describes a copier or printer having a transfer station that includes an improved debris-removing means that locates baffles and vacuum ports within the device, allowing for the collection and removal of the debris at specific locations. An electrical bias is selectively applicable to some of the baffles to attract the debris, while the vacuum operates continuously to remove the dirt and debris from within the printer or copier device. While the Gooray device describes a novel improvement to a copier or printer, wherein a debris removal system is described, its construction relies on integration into the design of the printer or copier prior to being delivered and used. The present invention provides a printer cartridge housing, having the same dimensions or fitment as a standard laser printer cartridge for a given printer, within which is provided a cavity to collect dirt, debris and paper dust by use of injected compressed air. The printer bias transfer roller is also cleaned using a drive gear drive roller located on the printer cartridge device.

U.S. Pat. No. 3,969,785 to Ogawa describes a residual toner removing apparatus comprising a cleaning brush, a duct section with a filter and a suction section operated by an air flow fan. Toner particles are removed from the bias transfer roller and collected by the apparatus for improved operation thereof. The Ogawa device utilizes a brush that sweeps debris and residual toner from the outer surface of a transfer roller, and further includes a means to suction and remove the removed debris once liberated from the roller surface. This device is useful for manually cleaning a roller, but lacks a means to collect debris and paper dust from the interior of a printer that is not attached to the roller, namely within the transport platform and open areas near a printer cartridge installation position.

U.S. Pat. No. 4,412,736 to Sakamoto describes an apparatus for collecting charged toner particles in combination with a fur brush cleaning device, which is useful for cleaning transfer type electro-photographic copying machines. The device utilizes a charge and a blade device to remove residual toner and to collect airborne toner particles from an air flow, cleaning a printer or photocopier. The device construction and intent differ from that of the present invention, as the present device utilizes compresses air, tacky interior surfaces within a cavity and a bias transfer roller cleaner to remove toner and debris.

The present invention provides a laser printer cleaning cartridge that inserts into a toner cartridge working position on a laser printer, comprising an interior cavity having adhesive foam tape on the walls to collect dust, dirt and debris from within the paper transport platform. A drive roller with a tacky outer surface contacts the bias transfer roller of a laser printer, removing residual toner from previous printing operations and cleaning the surface thereof. Located through the cleaning cartridge is a plurality of apertures that allow insertion of compressed air therein, stirring loose contents within the printer and adhering them to the cartridge cavity walls. The design of the present invention, and its means for cleaning substantially diverge in elements from the prior art, and consequently it is clear that there is a need in the art for an improvement to existing laser printer cleaning devices. In this regard the instant invention substantially fulfills these needs.

SUMMARY OF THE INVENTION

In view of the foregoing disadvantages inherent in the known types of laser printer cleaning devices now present in the prior art, the present invention provides a new cartridge cleaning devices wherein the same can be utilized for providing convenience for the user when removing loose debris, paper dust and residual toner from a laser printer assembly.

It is therefore an object of the present invention to provide a new and improved laser printer cleaning device that has all of the advantages of the prior art and none of the disadvantages.

Another object of the present invention to provide a cleaning device that fits into a laser printer toner cartridge mounting location within a printer, secures as a normal cartridge would and provides a means to clean the printer.

Another object of the present invention is to provide a cleaning cartridge with an interior cavity lined with adhesive foam tape and a drive roller with an adhesive outer surface to remove loose debris and clean the bias transfer roller, respectively.

Yet another object of the present invention is to provide a cleaning cartridge that allows compressed air to be inserted through nozzles that connect to conduit tubes, directing the compressed air into the printer transport platform to stir loose dirt, debris and paper dust for collection against the interior walls of the cleaning cartridge.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
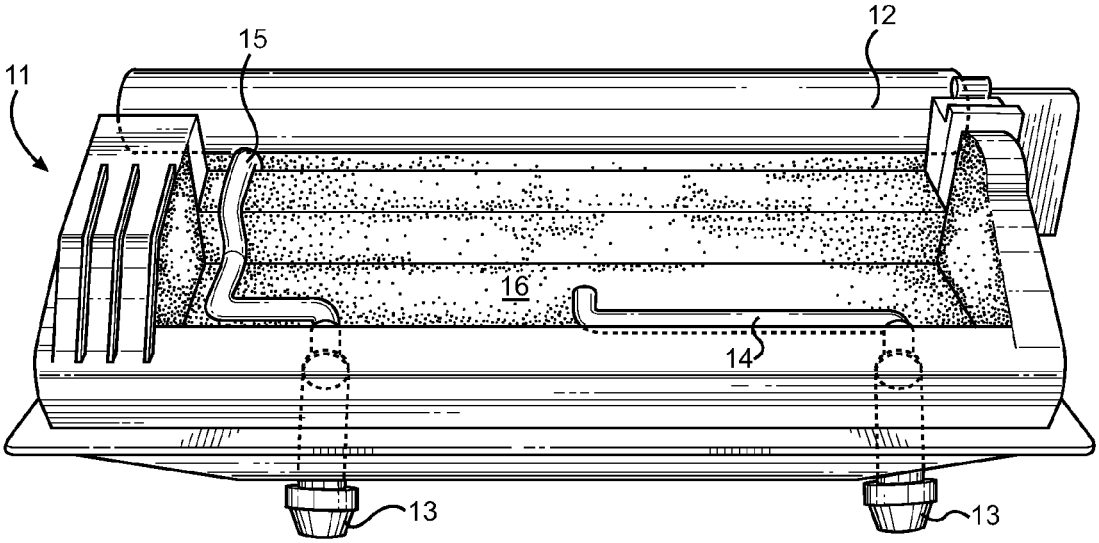
FIG. 1 shows a front perspective view of the present invention, wherein the internal cavity and drive roller are shown.

Reference is made herein to the attached drawings. Like reference numerals are used throughout the drawings to depict like or similar elements of the laser printer cleaning devices. For the purposes of presenting a brief and clear description of the present invention, the preferred embodiment will be discussed as used for cleaning the paper transport platform and bias transfer roller of loose debris and residual toner. The figures are intended for representative purposes only and should not be considered to be limiting in any respect.

Referring now to FIG. 1, there is shown a view of a laser printer cleaning cartridge device as described by the present invention from a front perspective. The present invention is a print cleaning cartridge that is intended to be installed in lieu of a process or toner cartridge in a laser printer. The underside of the device is highlighted, wherein a cavity is provided with walls lined with an adhesive foam tape material 16. The adhesive material 16 is utilized to attach loose debris, dirt and paper dust from within a laser printer device as it is being cleaned by the present invention. A plurality of air inlet nozzles 13 are provided along the top surface of the device, which connect to conduits leading to a first 14 and second 15 hollow guide tube. The tubes 14 and 15 provide direction for inflowing air that is introduced within the cavity of the device and the interior of the laser printer from two opposing locations on either side of a cleaning drive roller 12. Compressed air, in the form of a computer accessory compressed air canister, is used to force air into the nozzles 13 and through the guide tubes 14 and 15. Air is forced into the cavity, stirring loose debris for collection against the adhesive material 16 along the walls of the device interior cavity.

A centrally located drive roller 12 is a cylindrical body that rotates about a central axis and takes the position of a photoreceptor when acting as a replacement therefore. Its exterior surface is similarly covered with an adhesive layer, wherein the adhesive is designed to attach to residual toner when the roller 12 is pressed against the bias transfer roller of a laser printer, which is utilized to transfer toner to clean sheets of paper during the printing process. Residual toner degrades the quality and the resolution of the printing process, as unintended toner either blocks new toner from being attached to the transfer roller, or is reapplied in unintended locations on the printed product.

Figure 2:
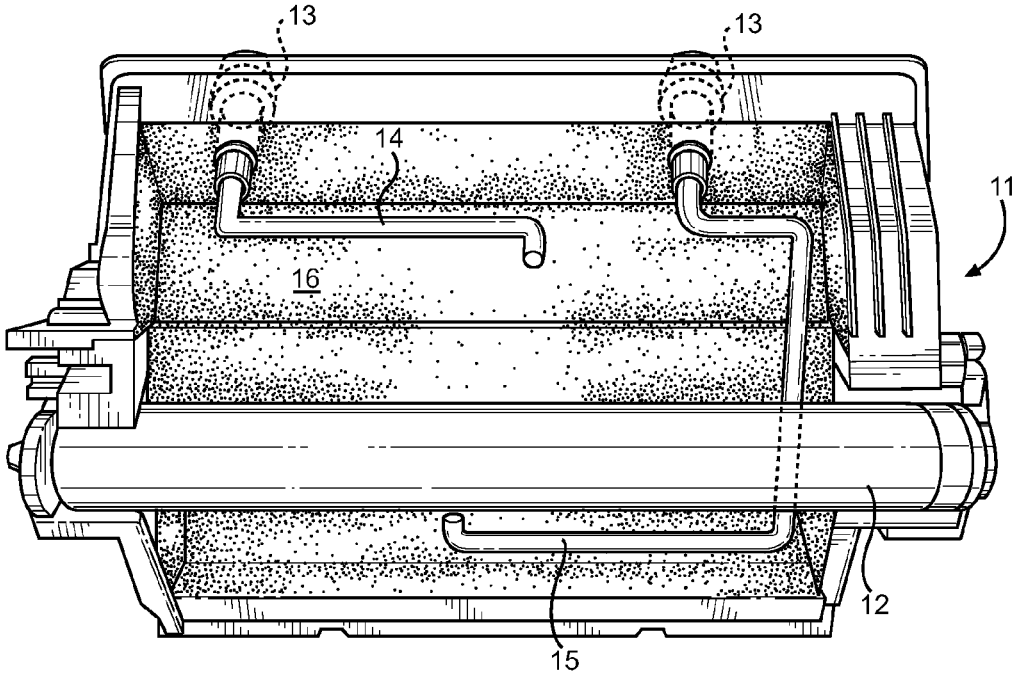
FIG. 2 shows an underside perspective view of the present invention, wherein the internal cavity and drive roller are shown.

Referring now to FIG. 2, there is shown an underside perspective view of the present invention, wherein the underside cavity includes adhesive foam tape 16 is provided. The device resembles a standard laser printer toner cartridge, and can take any shape or size suitable for a specific series of laser printer. The interior of the cartridge, however, does not contain new toner for utilization in a printing process, but a vacant cavity that is designed to capture and remove airborne particles and loose debris within the laser printer. The device is placed into position within a laser printer, in place of a new toner cartridge, to clean the device prior to reloading a new toner cartridge for continued use.

The air guide tubes 14 and 15 direct compressed air into the cavity, and provide an outlets that are located on either side of the drive roller 16 and on both ends of the internal cavity. Their location maximizes the pressure induced by compressed air, as air is directed in different directions to dislodge or stir up loose particles, dust and debris that may be located in a specific location that a single air inlet tube may not be able to adequately stir on its own. The drive roller 12 aligns with a bias transfer roller, as previously stated, to remove residual toner therefrom. This provides two modes of cleaning: one that removes debris and another that removes toner that is attached to the transfer roller.

Figure 3:
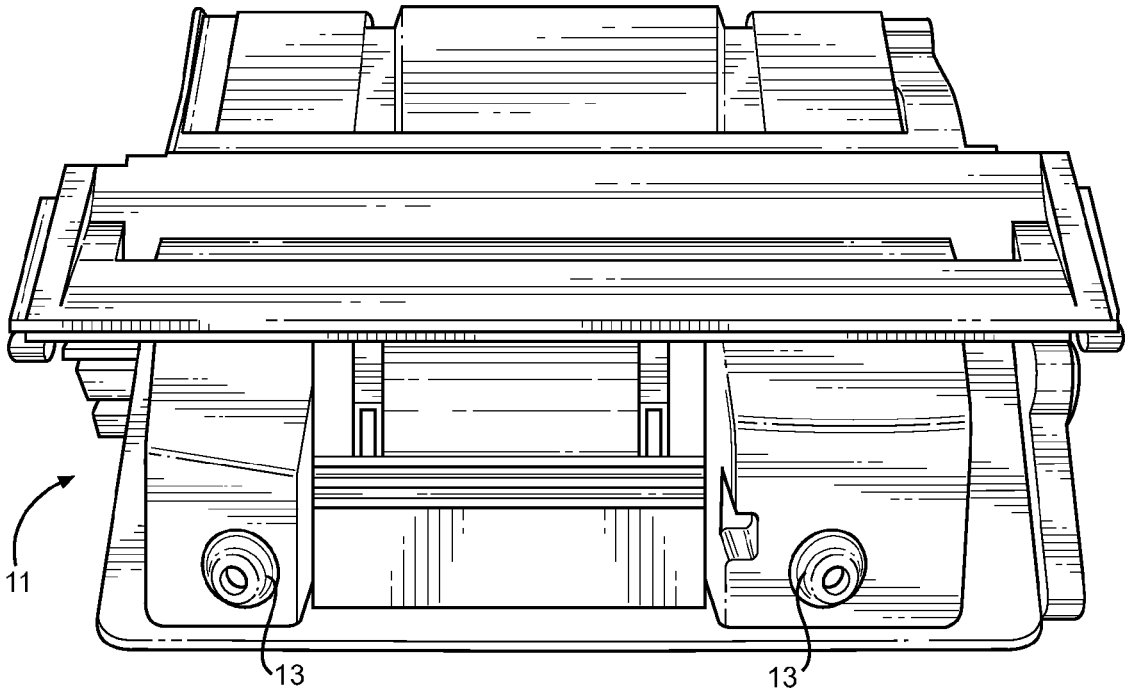
FIG. 3 show an overhead perspective view of the present invention, wherein the air inlet nozzles are shown.

Referring now to FIG. 3, there is shown an overhead view of the present invention, wherein the inlet nozzles 13 are present. This view is what a user sees after positioning the cleaning cartridge into a laser printer. A plurality of nozzles 13, in this embodiment two nozzles, provide a location to spray compressed air thereinto, which routes through the air guide tubes and into the interior cavity of the device and printer assembly. After all nozzles are sprayed into for a satisfactory amount of time, the printer can be closed as if being operated with a new toner replacement cartridge. After closure of the printer toner lid, the printer begins initializing the bias transfer roller for use. During this process, the drive roller 12 is depressed against the transfer roller and rotated. Rotation allows the adhesive outer surface of the roller 12 to contact the entire surface of the bias transfer roller, removing residual toner that may be affixed thereto. Once the initialization process is completed, the lid of the printer that provides access to the cartridge can be reopened for removal of the cleaning cartridge. Depending on the cost to the user and the number of spares, the cartridge can be discarded or its roller and adhesive foam tape replaced for reuse of the cartridge housing. A new toner cartridge may then be placed into the printer for continued operation of the printer after cleaning.

The adhesive material on the interior cavity of the cartridge may comprise an adhesive foam tape, which is attached to the cavity walls and provides a thickness to accept and grasp loose particles as they come into contact with one another. The drive roller is preferably covered with an adhesive material that does not have a substantial thickness, as it is depressed against the bias transfer roller and need not deform during this process. Further, the drive roller may also be sprayed with isopropyl alcohol or similar cleaning agent in lieu of an adhesive or use thereafter, further cleaning the transfer roller of toner and debris during contact.

The design of the cartridge housing is dependent on the make and model of the particular laser printer toner cartridge and its attachment location within the printer. It is not intended to limit the present invention to a specific housing, it is rather intended to disclose a cartridge housing with a hollow interior cavity, adhesive interior walls, compressed air inlet nozzles and guide tubes, and a drive roller that contacts the laser printer bias transfer roller. Each housing may be designed to work with a particular line of laser printers, and be specific to that brand or model.

Use of the present invention is intended primarily for laypersons or office workers with minimal printer maintenance experience. The device loads exactly as a replacement toner cartridge, requires use of a compressed air canister and the time required to initialize the printer by closing the toner replacement lid. Continual use of the device between toner replacements reduces buildup of dust, dirt, debris and toner within the printer assembly, which reduces the likelihood of breakdowns, repairs, poor quality and malfunctions due to foreign object debris interference with the working elements of the printer. It is intended to prolong the life of a printer, reduce maintenance costs, extend service intervals and improve printer quality. The device may be designed for one-time use, or may be reusable if desired. The adhesive material and the drive roller would be replaceable in a reusable form, wherein fresh cleaning and containment surfaces are provided for each use.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A laser printer cleaning cartridge for removing toner and debris from a laser printer bias transfer roller, comprising:

a cartridge housing having a hollow interior section, a plurality of air inlets and air guide tubes, and a rotatable drive roller;

said hollow interior having walls lined with an adhesive foam tape, said tape being adapted to accept and grasp loose particles as they come into contact therewith;

said air inlets are disposed along a top surface of said cartridge and are connected to a first and second hollow guide tube for directing air from a compressed air canister and into said hollow interior section for stirring loose debris for collection against said adhesive material along said interior cavity side walls;

said drive roller being covered with an adhesive material and in operative contact with a bias transfer roller for removing toner and debris from said laser printer bias transfer roller.

2. The device of claim 1, wherein said plurality of air guide tubes direct air from opposing ends of said interior cavity.

3. The device of claim 1, wherein said plurality of air guide tubes direct air from opposite sides of said drive roller.

4. The device of claim 1, wherein said drive roller and interior wall adhesive is removable and replaceable for reusing said cartridge housing.

5. A laser printer cleaning cartridge for removing toner and debris from a laser printer bias transfer roller, comprising:

a cartridge housing having a hollow interior section, a plurality of air inlets and air guide tubes, and a rotatable drive roller;

said hollow interior having walls lined with an adhesive foam tape, said tape being adapted to accept and grasp loose particles as they come into contact therewith;

said air inlets are disposed along a top surface of said cartridge and are connected to a first and second hollow guide tube for directing air from a compressed air canister and into said hollow interior section for stirring loose debris for collection against said adhesive material along said interior cavity side walls;

said drive roller being covered with an adhesive material and in operative contact with a bias transfer roller for removing toner and debris from said laser printer bias transfer roller, said drive roller further having an outer layer of cleaning fluid for removing toner and debris from a laser printer bias transfer roller.

6. The device of claim 5, wherein said cleaning fluid comprises isopropyl alcohol.

7. The device of claim 5, wherein said plurality of air guide tubes direct air from opposing ends of said interior cavity.

8. The device of claim 5, wherein said plurality of air guide tubes direct air from opposite sides of said drive roller.

9. The device of claim 6, wherein said drive roller and interior wall adhesive is removable and replaceable for reusing said cartridge housing.

* * * * *